US010066389B2

(12) United States Patent
Caimi

(10) Patent No.: US 10,066,389 B2
(45) Date of Patent: Sep. 4, 2018

(54) JOINING ELEMENT FOR CONNECTING TOGETHER TWO OR MORE PANELS

(71) Applicant: ELEDA S.r.l., Milan (IT)

(72) Inventor: Renato Caimi, Milan (IT)

(73) Assignee: Caimi Brevetti S.p.A., Nova Milanese (MB) (IT)

( * ) Notice: Subject to any disclaimer, the term of this patent is extended or adjusted under 35 U.S.C. 154(b) by 0 days.

(21) Appl. No.: 15/127,530

(22) PCT Filed: Mar. 31, 2015

(86) PCT No.: PCT/IB2015/000435
§ 371 (c)(1),
(2) Date: Sep. 20, 2016

(87) PCT Pub. No.: WO2015/150905
PCT Pub. Date: Oct. 8, 2015

(65) Prior Publication Data

US 2017/0145688 A1 May 25, 2017

(30) Foreign Application Priority Data

Mar. 31, 2014 (IT) ..... MI20140125 U

(51) Int. Cl.
*E06B 3/48* (2006.01)
*E06B 7/086* (2006.01)
*E04B 2/74* (2006.01)

(52) U.S. Cl.
CPC ..... *E04B 2/7403* (2013.01); *E04B 2/7405* (2013.01); *E04B 2/7429* (2013.01)

(58) Field of Classification Search
CPC .... E04B 2/7429; E04B 2/7425; Y10T 16/525; Y10T 16/5257
USPC ..... 160/135, 229.1
See application file for complete search history.

(56) References Cited

U.S. PATENT DOCUMENTS

| | | | | |
|---|---|---|---|---|
| 3,927,438 | A | 12/1975 | Blake | |
| 4,562,675 | A * | 1/1986 | Baigas, Jr. | E06B 3/285 160/354 |
| 5,729,867 | A * | 3/1998 | Carmichael | E04B 2/7429 16/225 |
| 5,732,757 | A | 3/1998 | Mariol | |
| 2002/0117273 | A1* | 8/2002 | Huang | B60J 1/2091 160/370.23 |
| 2011/0124953 | A1* | 5/2011 | Novak | A47C 1/146 600/27 |

FOREIGN PATENT DOCUMENTS

| | | |
|---|---|---|
| DE | 2902510 | 7/1980 |
| WO | 83/02795 | 8/1983 |

* cited by examiner

*Primary Examiner* — Katherine W Mitchell
*Assistant Examiner* — Jeremy C Ramsey
(74) *Attorney, Agent, or Firm* — Patti & Malvone Law Group, LLC

(57) ABSTRACT

A joining element for connecting together two or more panels is disclosed. The joining element includes at least one strip section; wherein the strip section forms a first part and a second part; wherein the first part and the second part are connected together along a hinge line or area. In addition, the second part includes a connection member designed to engage with a complementary connection member. In one embodiment the connection members comprise a button and an eyelet.

11 Claims, 17 Drawing Sheets

JOINING ELEMENT FOR CONNECTING TOGETHER TWO OR MORE PANELS

FIELD OF THE INVENTION

The present invention relates to a joining element for hingeably connecting together two or more panels. The panels may be sound-proofing, sound-reflecting or other types of panels.

BACKGROUND OF THE INVENTION

It is known that, when a sound wave emitted in a closed room encounters a surface, part of its energy passes through the surface, part is absorbed by the impact with the surface and part is reflected into the room.

If, in a room, the reflective surface area is high, the room may be acoustically very disturbed since the sound waves produced inside it are amplified with an effect similar to that of an echo.

In order to improve the acoustics of a room, without structural modifications, it is known to provide in the room one or more sound-absorbing panels for absorbing a large part of the energy.

The acoustic correction measures involve lining the internal surfaces of the rooms with sound-proofing materials; they must have not only acoustic but also aesthetic characteristics suitable for allowing them to blend in with the interior design and furnishings.

Sound-proofing materials have the property that they absorb at least a part of the acoustic energy and reduce the amount of reflected energy.

The known sound-proofing panels, to be applied for example to a wall, have a structure composed of a layer of foam (for example foam rubber) lined with a sheet and kept rigid by a perimetral frame made of metal (for example aluminium), plastic or wood. The sheet is typically wound around the perimetral frame so as not to show, at least on a visible side, stitching or other joints. However, when a sound-proofing panel must have two visible sides, it is more difficult to mask a joint in the sheet in a zone where one edge of the sheet overlaps the other edge of the sheet.

In other known panels, the padding layer is combined with a rigid surface (for example made of metal, plastic or wood) which increases the rigidity thereof. The rigid surface may be positioned on one side of the padding or inside the padding itself, creating a sandwich structure.

A first drawback of the sound-proofing panels made according to the prior art consists in the presence of the frame or support surface. They may in fact have a considerable weight and therefore be difficult to handle, install and support; moreover often the frame or the support surface constitute the most costly item of the panel.

Another drawback, as already mentioned, is that the sound-proofing panels must have not only good sound-absorbing properties, but also satisfactory aesthetic characteristics since they must blend in with the interior design and the furnishings. The frame and the joints between two sheet edges used to cover the panel undoubtedly constitute unattractive features which do not blend in with the surroundings.

The problem which arises is that of providing a joining element for connecting together, in substantially hinged fashion, two or more panels in a simple, low-cost and removable manner.

SUMMARY OF THE INVENTION

According to the Applicant, the problem may be solved by means of a joining element for connecting together two or more panels,

- wherein said joining element comprises at least one strip section;
- wherein said strip section forms a first part and a second part;
- wherein said first part and said second part are connected together along a hinge line or area;
- wherein the second part comprises a connection member designed to engage with a complementary connection member.

The connection member may be a button, for example a button of the type generally stitched with a thread to clothing or a button (often metallic) commonly used, for example, for jeans or other casual trousers. These types of buttons are generally riveted. The connection member which complements the button may be an eyelet.

Alternatively, the connection member and the complementary connection member may be a hook and an eyelet.

Alternatively, the connection member and the complementary connection member may be a buckle and a hole (the tongue of the buckle is inserted inside a hole).

Alternatively, the connection member and the complementary connection member may be small hooks and loops. This connection system is often known as a Velcro® fastening system.

Alternatively, the connection member and the complementary connection member may be of the "automatic button" type with an automatic male button and an automatic female button.

Alternatively, the connection member and the complementary connection member may be of the magnetic type, with a positive magnetic member and a negative magnetic member.

The two connection members may be engaged, released and engaged again many times.

Optionally, the connection members may also be a combination of the aforementioned members.

The second part may comprise two edge portions with free ends.

The first part may comprise two edge portions with free ends.

The first part may be shaped as a closed loop.

In embodiments, the first part comprises at least two buttons.

In embodiments, the first part comprises at least two eyelets. In embodiments, the first part comprises at least two eyelets.

The strip section may be made of an at least partially elastic material so as to adhere to the shape of a panel. Alternatively, it may be made of a textile material, a plastic material or a material punched from a flexible material.

In embodiments, the buttons are fixed to a panel.

In embodiments, the hinge line or area is formed by means of stitching, welding, gluing, stapling or a combination of these operations.

According to a second aspect, the invention relates to a panel assembly comprising at least two panels and at least one joining element according to any one of the preceding claims, with a connection member which engages with a corresponding complementary connection member, for example, at least one button engaging with an eyelet.

The panels may be sound-absorbing panels comprising heat-bonded synthetic fibres. The heat-bonded synthetic fibres may comprise polyester fibres.

DETAILED DESCRIPTION OF THE INVENTION

In the present description, for the sake of simplicity, the term "sound-proofing panel" is mainly used, but it is understood that this wording embraces other panels which influence the acoustics of a room, for example sound-reflecting panels. The term, for the purposes of the present description and the claims, also embraces any panel, which also does not have sound-absorbing and/or sound-reflecting characteristics. The panel may be made of any material, for example wood or wood derivatives (chipboard, MDF, veneered, etc.), metal, plastic or glass. The panel, alternatively, could be made of cardboard or the like, expanded foam or textile material. Optionally the panel could be made of a combination of the aforementioned materials.

There now follows a detailed description of a particular type of sound-absorbing panel which is particularly suitable for use with the joining element according to the invention. This specific description is not to be understood as limiting the scope of protection, but is provided solely by way of example.

Figure 1:
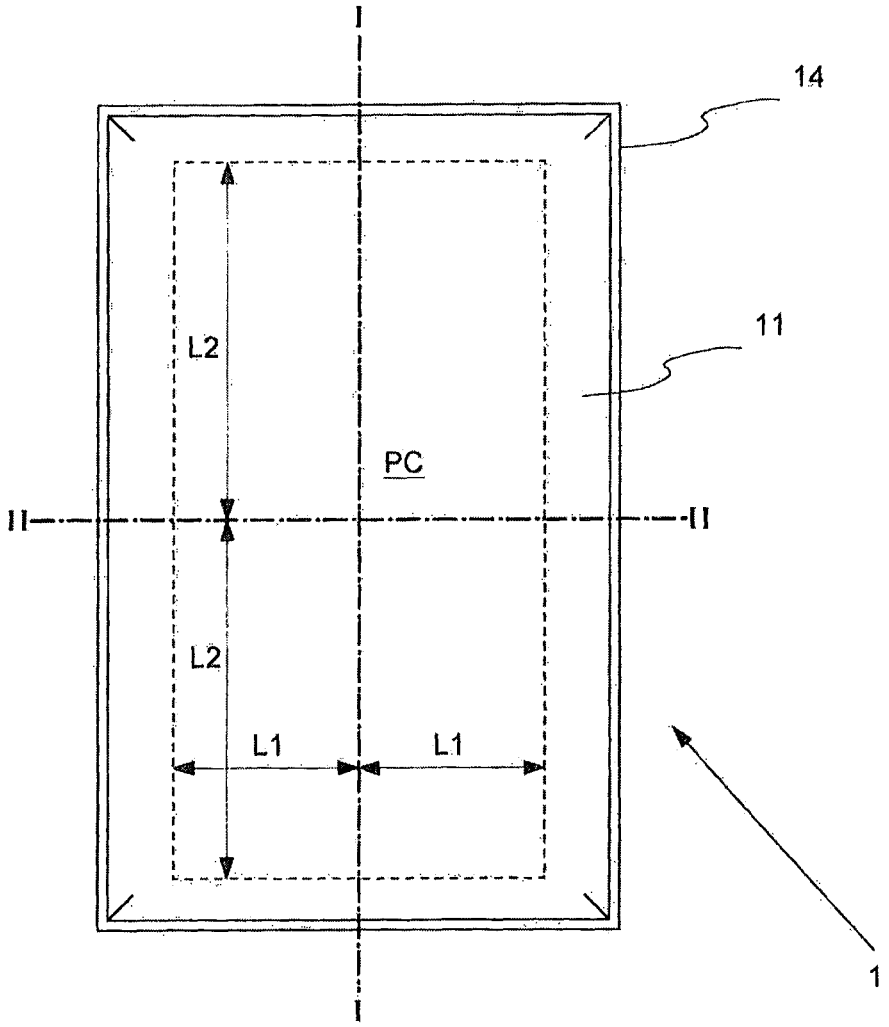
FIG. 1 is a schematic front view of a sound-proofing panel suitable for use with the present invention.
Figure 2:
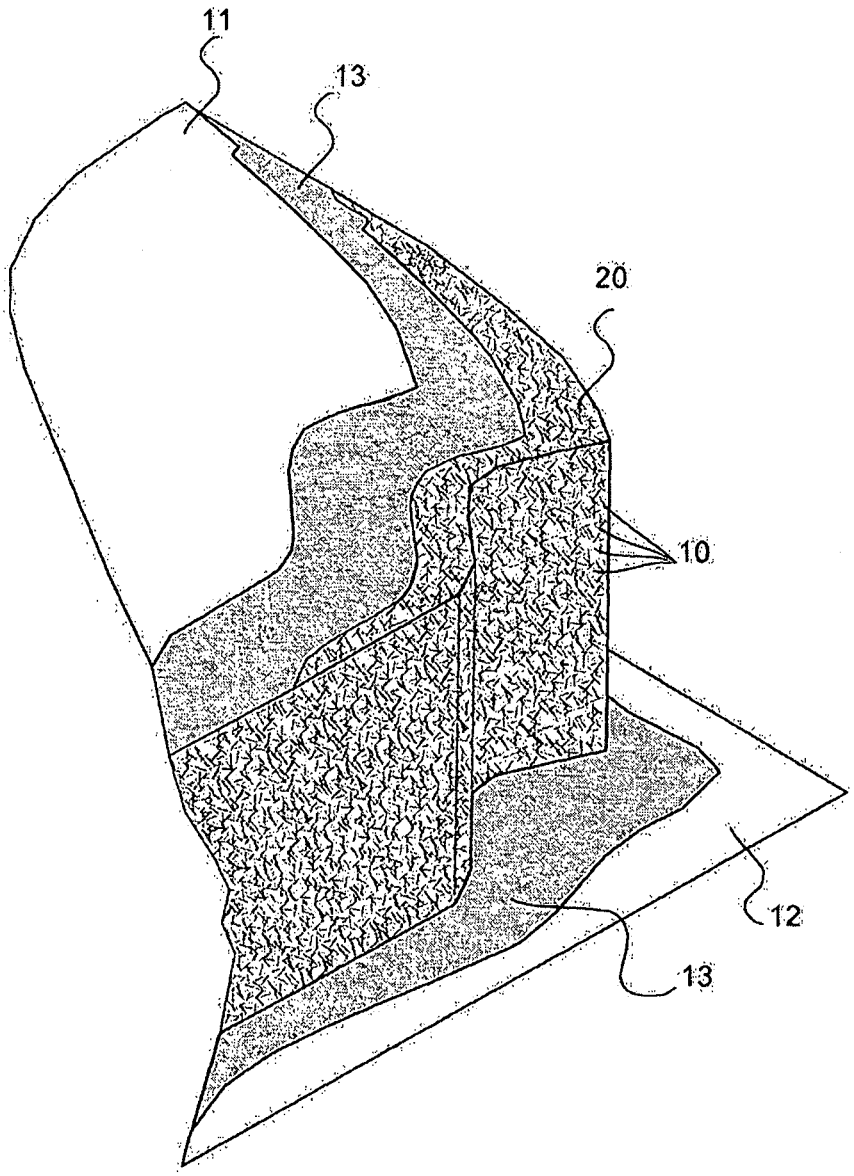
FIG. 2 shows the various layers of the panel according to FIG. 1.
Figure 3:
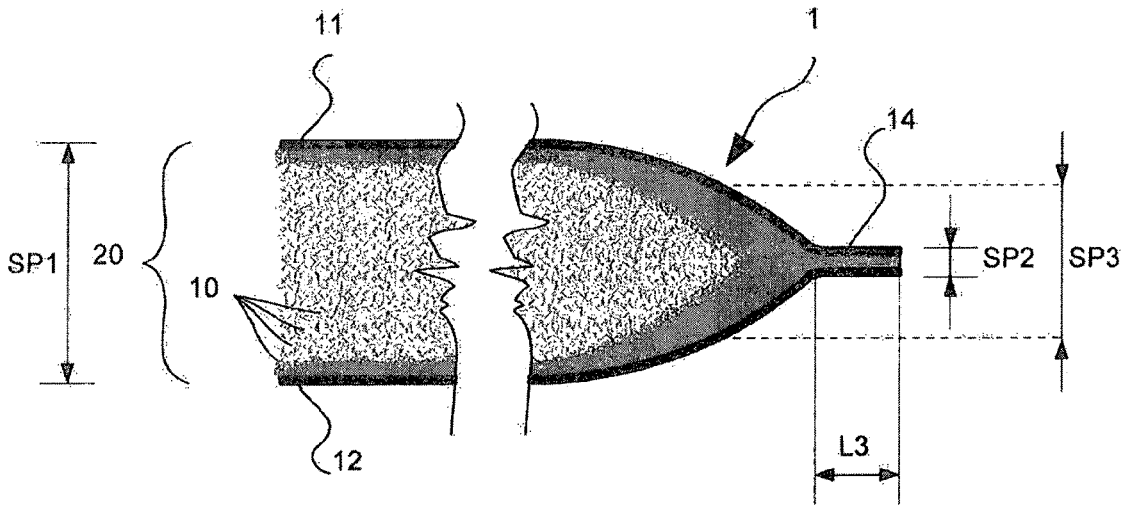
FIG. 3 is a schematic cross-sectional view of a part of the panel according to FIG. 1.

With reference to FIGS. 1, 2 and 3, these show a sound-proofing panel 1 comprising a padding layer 20 which is preferably shaped. It preferably comprises heat-bonded synthetic fibres 10, and a first and second layer of fabric facing each other on opposite sides of the padding layer 20. The padding layer 20 is shaped so as to have an edge 14 with a smaller thickness than the thickness of the padding layer in a central position of the panel 1. The edge has an edge width indicated by L3 in FIG. 3.

The panel may have a rectangular shape (as in FIG. 1) or any other shape such as a square, irregular quadrilateral, trapezoidal, circular, oval, elliptical, triangular or other shape.

In one embodiment, the heat-bonded synthetic fibres 10 comprise polyester fibres.

Preferably, the fibres are non-toxic and non-irritants. Furthermore they may be able to be fully recycled.

The sound-proofing panel 1 preferably comprises a first layer of fabric 11 facing a first side of the padding layer 20. The sound-proofing panel 1 also comprises, preferably, a second layer of fabric 12 facing a second opposite side of the padding layer 20 (FIG. 3).

Preferably, the layers of fabric 11, 12 are also made of polyester.

In one embodiment, the fabric is of the Trevira CS flame-retarding type.

The panel 1 may comprise preferably an adhesive layer 13 arranged between the padding layer 20 and each of the layers of fabric 11 and 12.

In particular, the adhesive layer 13 may advantageously comprise a layer of glue, preferably applied by means of spreading.

The panel 1, in a central position P thereof (FIG. 1), has a first thickness SP1 (FIG. 3) preferably of between about 2 cm and about 7 cm. In one embodiment, the first thickness SP1 is about 3.7 cm.

For the purposes of the present description and the accompanying claims, the term "central position PC" is understood as meaning a position inside a central area of the panel. In turn, the term "central area" is understood as meaning an area which is sufficiently distant from the perimeter of the panel and from the transition contour. For example, for a rectangular shaped panel with a first axis parallel to the long side and a second axis parallel to the short side, the central area is a substantially rectangular area symmetrical relative to the first and second axes. The central area may have a width equal to 2×L1, where L1 is about 30% of the width of the panel, and a length equal to 2×L2, where L2 is about 30-40% of the height of the panel. FIG. 1 shows by way of example, indicated by a broken line, a central area for the panel 1. In the case of a square shaped panel, the central area may have a square area centred on the centre of the panel having a side with a length equal to about 50% of the side of the panel. In the case of a circular shaped panel, the central area may be a central area centred on the centre of the panel and having a diameter equal to about 50% of the panel diameter. In the central area there may be depressions used for fastening purposes, but these local depressions with a small thickness must not be taken into consideration when evaluating the thickness of the panel in the central area.

Advantageously, the panel 1 may be shaped so as to have an edge 14 with a second thickness SP2, smaller than the first thickness SP1 (FIG. 3). The edge 14 has a width L3 which may be for example equal to about 0.5-2 cm.

The second thickness SP2 in the region of the edge 14 may be between 5% and about 30% of the first thickness SP1.

The edge 14 may be formed along at least part of the perimeter of the panel 1 or, alternatively, along the entire perimeter of the panel 1.

The panel 1 may have a transition thickness SP3 (FIG. 3) which is variable depending on the distance between the edge 14 and the central position P.

In particular, the transition thickness SP3 increases from the value of the second thickness SP2 to the value of the first thickness SP1 with a substantially logarithmic progression as the distance from the edge 14 increases.

The panel 1 has density values which vary from the central position P as far as the edge 14.

Moreover, preferably, the padding layer 20, in at least one portion of the panel (for example the central area PC), has a variable density, which is greater in the region of its outer layer and smaller in the region of its inner layer.

Advantageously, according to the invention, the structure created does not require any support frame; in fact the edge 14 acts as a frame.

Moreover, the panel does not require any joint between sheet edges, since no covering sheet is envisaged; the covering, in fact, in one embodiment, consists of the layers of fabric 11 and 12 which form a single body with the padding layer 20. The aesthetic characteristics, therefore, are particularly attractive and may be blended in (also in terms of colours or shapes) with the characteristics of the surroundings.

The low weight of the panel 1 facilitates the design of all the supporting means necessary for hanging or joining the panel.

Preferably, the padding layer 20 and the layers of fabric 11, 12 are made of fireproof material.

Preferably, the padding layer 20 and the layers of fabric 11, 12 are treated with antibacterial material.

In short, the panel achieves a number of advantages: it does not require any support frame because the edge acts as a frame; it does not require any joint between sheet edges since (at least in one embodiment) no covering sheet is envisaged; the covering, in fact, consists of the layers of fabric which form a single body with the padding layer, the aesthetic characteristics are particularly attractive and may be blended in with the characteristics of the surroundings.

The edge also acts, at least partly, as a sound-proofing material and prevents reverberation of the sound waves.

The panel may be easily supported since it has a very low weight compared to the panels of the prior art.

The low weight of the panel facilitates the design of all the supporting means necessary for hanging or joining the panel.

It is fully recyclable since it is made entirely of polyester.

Figure 4A:
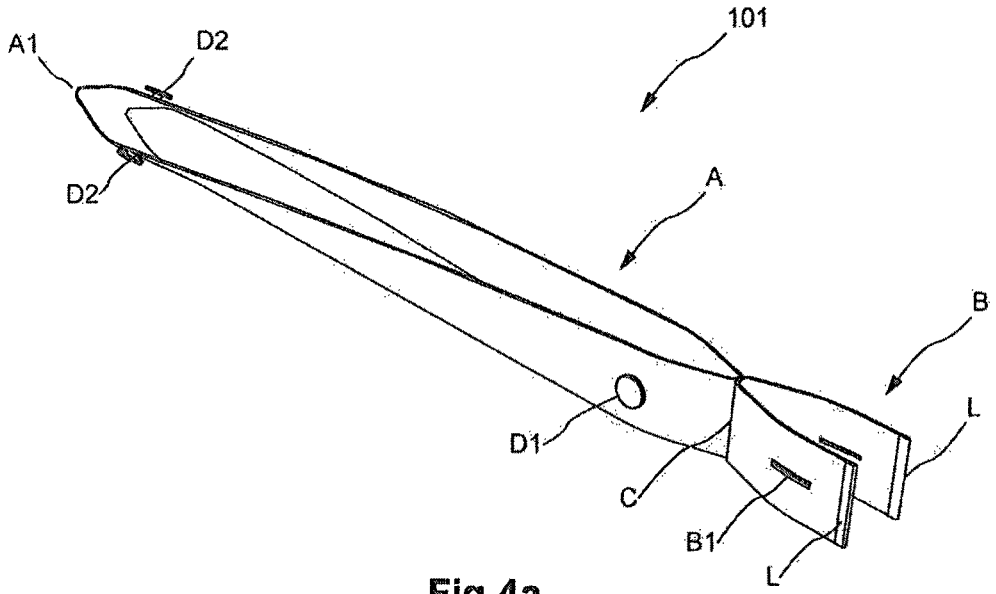
FIGS. 4*a* and 4*b* are two views of a first embodiment of the joining element according to the invention.
Figure 4B:
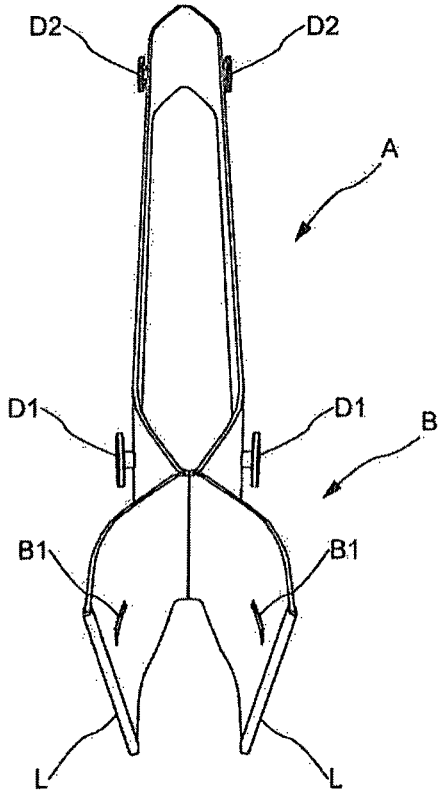

FIGS. 4*a* and 4*b* are two different views of a first embodiment of a joining element 101 according to the invention.

For the sake of simplicity, in the various figures only a combination of fastening members of the button and eyelet type are shown. Obviously, this choice is only of exemplary nature and is not to be understood as limiting the scope of the invention. Functionally equivalent members chosen from among the following pairs of members may be used: eyelet and button, eyelet and hook, buckle and hole, small hooks and loops (Velcro® and the like), automatic male button and automatic female button, positive magnetic member and negative magnetic member, or a combination thereof.

The joining element comprises a strip. The joining element may comprise a single strip or several strips.

The joining element 101 comprises a first part A and a second part B. In the first embodiment (FIGS. 4*a* and 4*b*), the first part A is shaped as a closed loop, while the second part B is shaped so as to have two free edge portions L. In other embodiments, not shown, but included in the scope of protection of the invention, also only a single free edge portion could be provided. For example, the embodiment with a single edge portion could be advantageously used for configurations consisting of three or more panels provided in a closed arrangement so as to form a polygon (triangle, equilateral triangle, square, rhombus, pentagon, etc.).

In FIGS. 4*a* and 4*b* the first part A in the form of a closed loop is shown with a certain shape, similar to the cross-section of the panel, but it is evident that this representation may not correspond to a real representation since the strip could have only a small degree of rigidity and might not maintain the shape shown in the figures.

As briefly mentioned above, the joining element 101 could comprise a single strip or several strips. For example, with reference to FIGS. 4*a* and 4*b*, the first part A could be formed with one strip and the second part B could be formed with another strip. Alternatively, the first and second parts A, B could be formed by a single strip. By way of a further alternative, the first part A could be formed by two strip sections and the second part B could be formed by two strip sections (the same as the first part or different).

The first part A and the second part B are joined together along a hinge line or a hinge area C. The type of joint between the first and second parts depends on the type of material used for the strip or strips. For example, the two parts could be glued, welded, stitched, stapled or joined together by means of two or more of the aforementioned systems.

The first part A comprises at least two buttons D1, D2 situated towards the outside of the closed loop. In the embodiment shown in the figures, the first part comprises four buttons. The number of buttons D1,D2 could, however, be greater or smaller than four.

Preferably, the buttons D1,D2 of the first part consist of an even number and are arranged, in pairs, at a same distance from the hinge line (or area). Preferably, the distance of the buttons D1, which are closest, from the hinge line (or area) C is substantially the same as the distance of the other buttons D2 from the "tip" A1 of the closed loop. The "tip" A1 of the closed loop is the end furthest from the hinge point C when the loop is flattened substantially in a plane.

Each button D1,D2 has a shank G and a head T with a diameter greater than the diameter of the shank G. Preferably, both the shank and the head have a circular cross-section.

Each button D1,D2 may be fixed in a known manner to the strip. Typically, each button is riveted.

The second part B could also comprise two eyelets B1. The eyelets B1 of the second part B could also consist of a number greater than two. Preferably, the centre of each eyelet is arranged substantially at a distance from the hinge line (or area) C corresponding to the distance between each of the buttons D1 and the hinge line (or area) C.

Preferably, the eyelets B1 of the second part extend in the longitudinal direction of the strip, i.e. in the direction of its length.

The free ends L of the second part B are preferably finished for example with an edge, a rim or a finishing strip.

Figure 5:
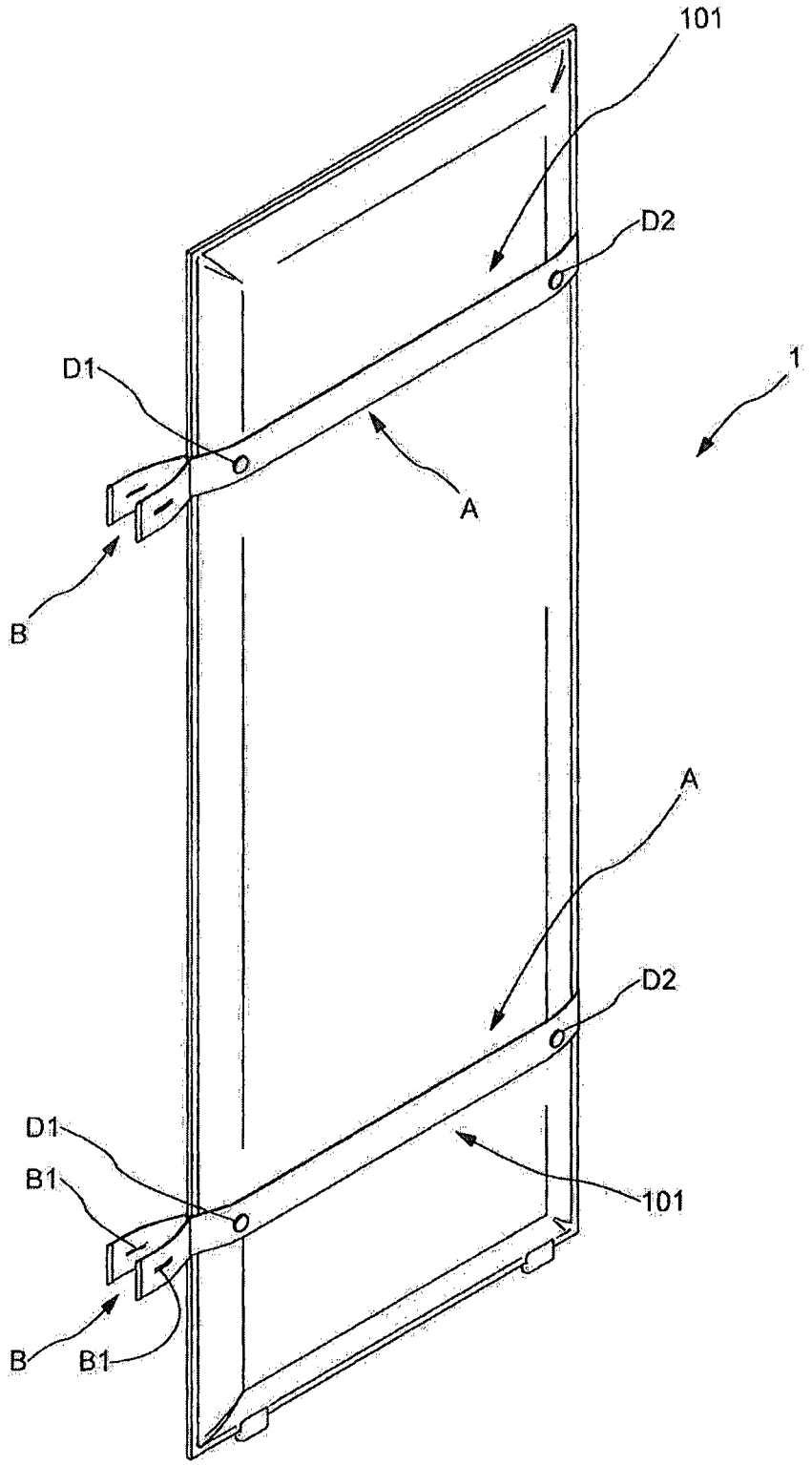
FIG. 5 is an axonometric view of the panel according to FIG. 5 with two joining elements according to FIG. 4.

FIG. 5 shows in schematic form two joining elements 101 according to the first embodiment of the invention mounted on a panel 1. The first part of the top joining element has been fitted so as to embrace the panel 1 and adhere to it at least over most of its surface. In this way, the top joining element 101 is fixed in a sufficiently stable and precise manner to the panel.

The bottom joining element is assembled in the same manner.

In this way, for each of the two joining elements 101 (top element and bottom element) there will be two free edge portions L available for connection to another panel 1.

The buttons of a corresponding joining element fitted onto another panel may be inserted into the eyelets B1 of the second part B of the two joining elements 101. In this way, the two panels are connected together in a substantially hinged manner.

Figure 6A:
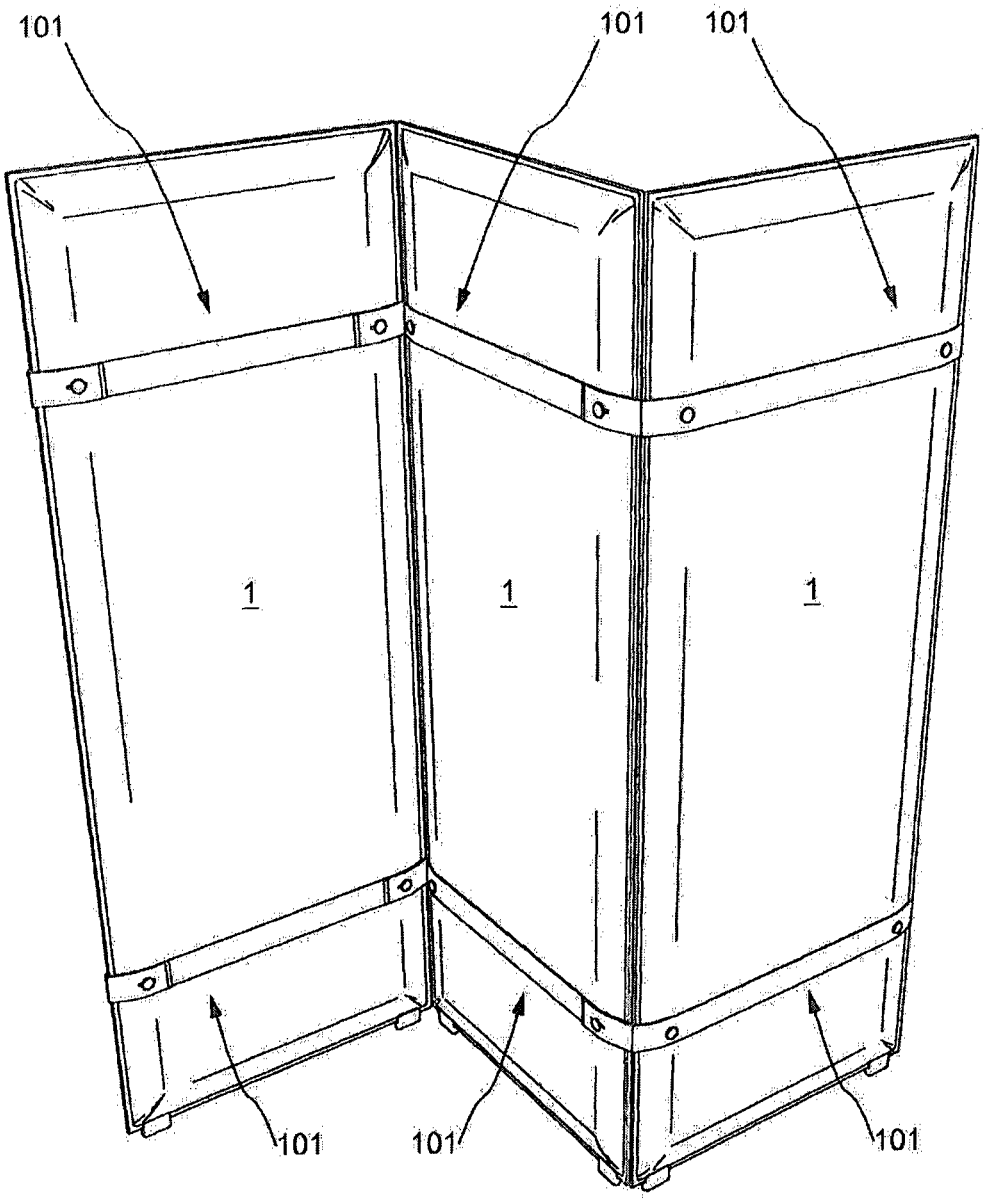
FIGS. 6*a* and 6*b* show two different compositions of panels obtained with joining elements according to the invention.

FIG. 6*a* shows three panels 1 which are joined together using six joining elements 101 according to the first embodiment of the invention.

Figure 6B:
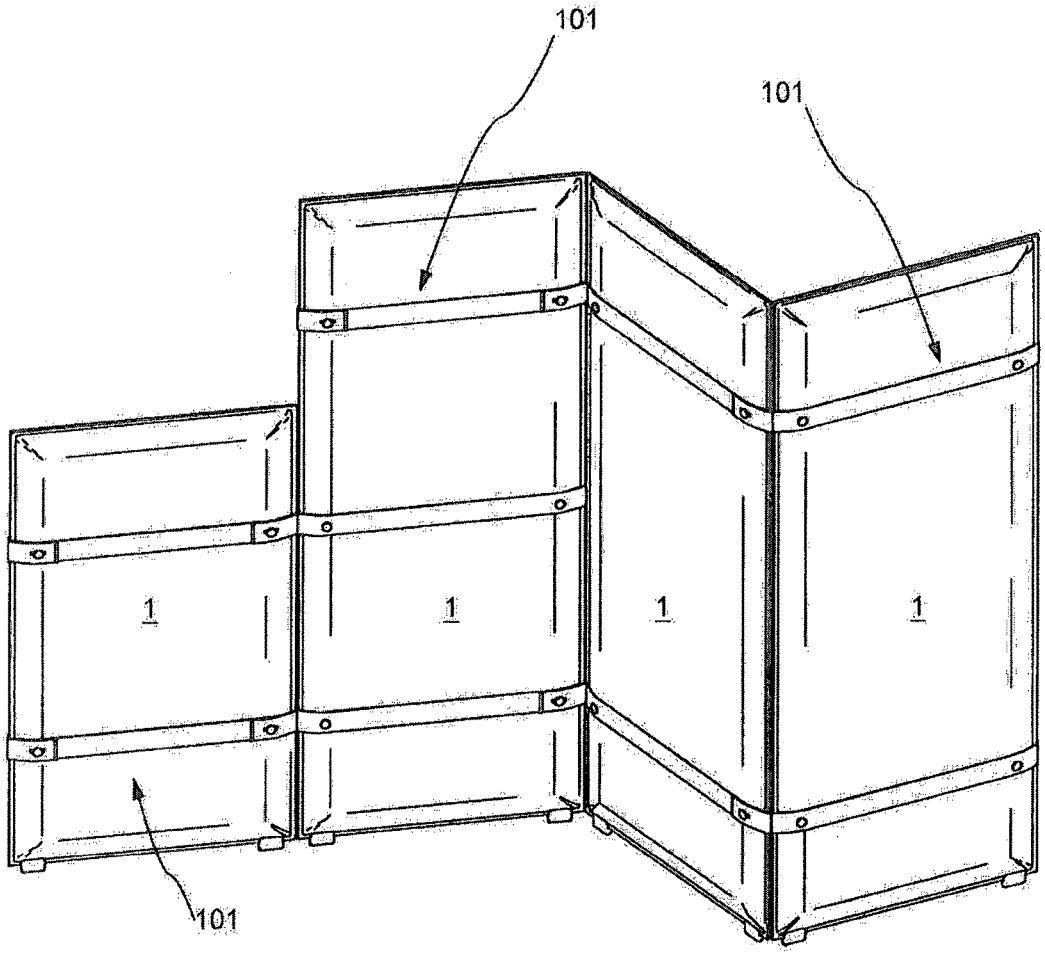

FIG. 6*b* shows another of the substantially infinite combinations which can be obtained with the joining element according to the first embodiment of the invention. The inclination of one panel with respect to the other one may also be different from that shown.

Figure 7:
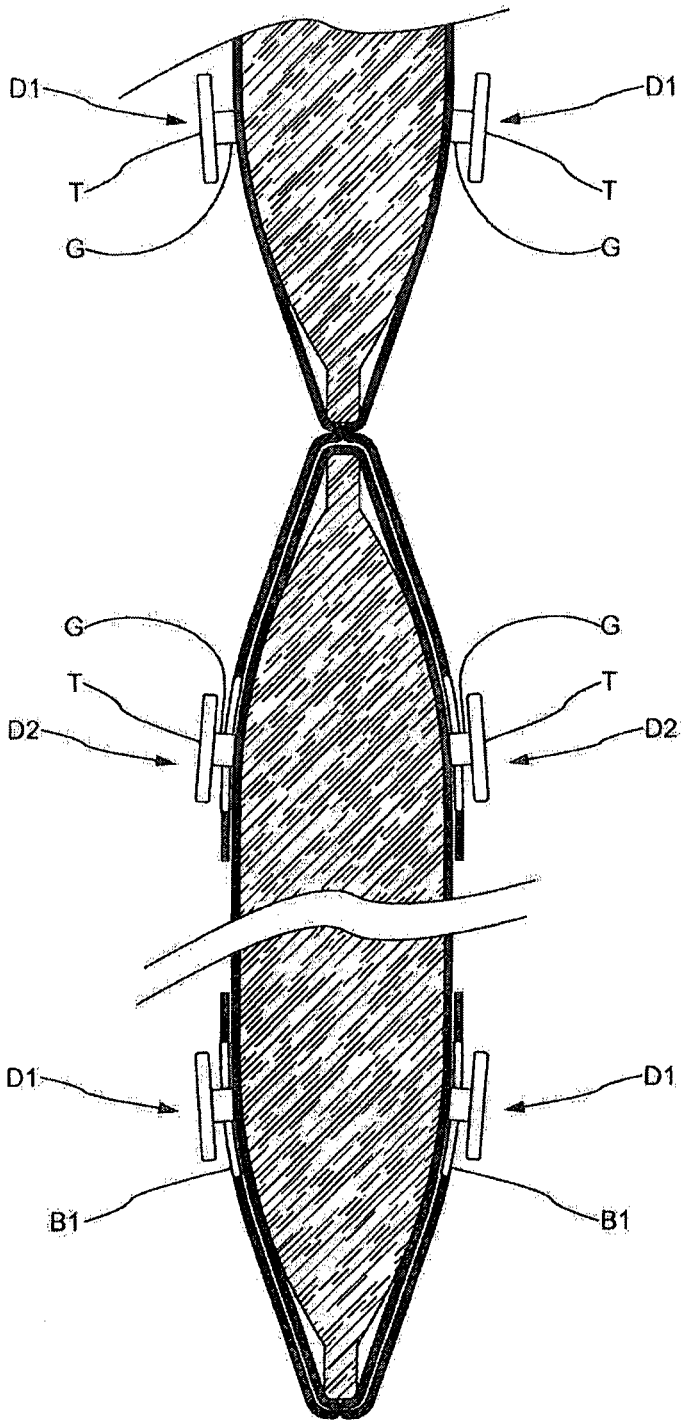
FIG. 7 is a schematic cross-sectional view of two panels connected together by means of joining elements according to the first embodiment of the invention.

One of the advantages of the present invention is that the strips which form the joining elements are relatively thin and may be arranged on top of each other. FIG. 7 illustrates this advantage in schematic form.

FIG. 7 shows a cross-section of two panels 1. The cross-sections are effected along a plane on which the buttons D1,D2 lie. The two panels shown in FIG. 7 may consist of two of the panels shown in FIG. 6*a* or 6*b* (for example the central panel and the left-hand panel in FIG. 6*a*). In practice, the two panels are joined together by means of two joining elements 101; the eyelets B1 of one joining element are engaged by two of the buttons D2 of the other joining element. If one of the two panels is the terminal element in an arrangement of panels, the free edge portions L are folded back and fixed (via the eyelets) to the buttons D1 of the same joining element 101.

In this way, each panel 1 is embraced by straps which adhere in a continuous manner without free edge portions which are dangling.

Figure 8:
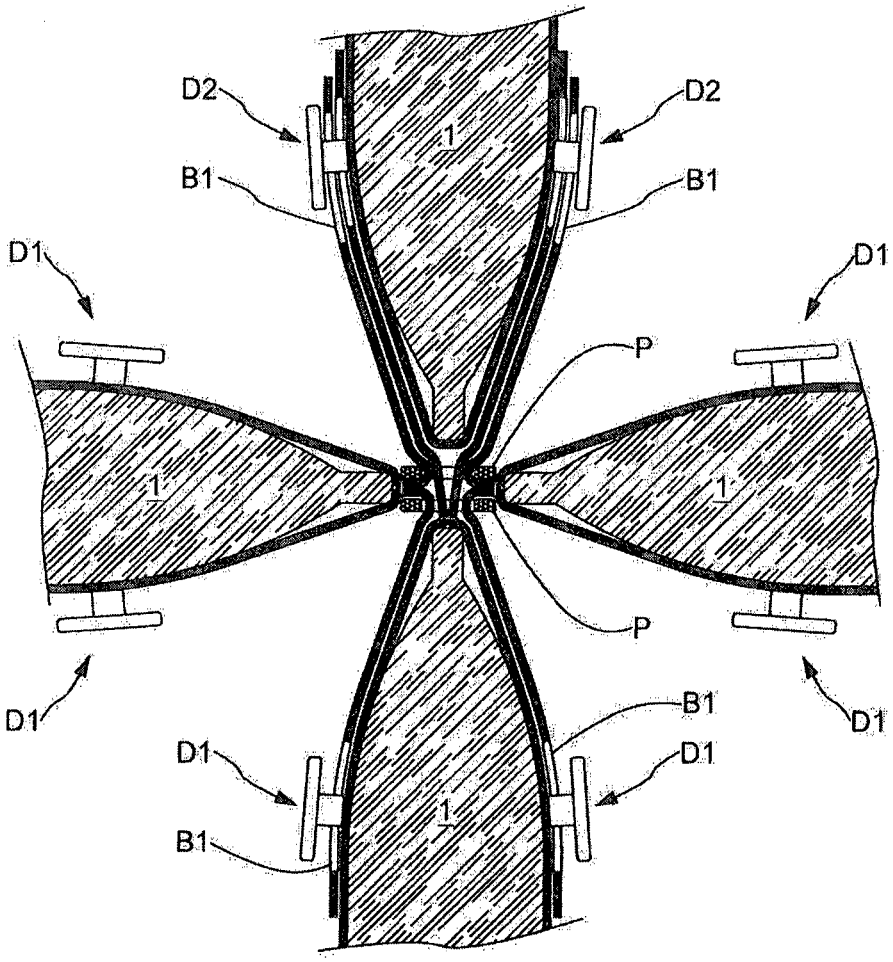
FIG. 8 is a schematic cross-sectional view of four panels connected together by means of joining elements according to the invention.

In addition to the possibility of joining together two or more panels so as to form a wall (optionally with angled panels as shown in FIGS. 6*a* and 6*b*), with the present invention it is also possible to form angled walls, by suitably connecting together three, four or more panels using a certain number of joining elements 101 according to the invention. This advantageous aspect is shown in schematic form in FIG. 8. In addition to the joining elements already described rigid sleeves P, for example made of metal, plastic or the like, may be used. FIG. 8 shows two sleeves P in cross-section. The sleeves P have substantially the function of keeping the free edge portions L close together.

Figure 9A:
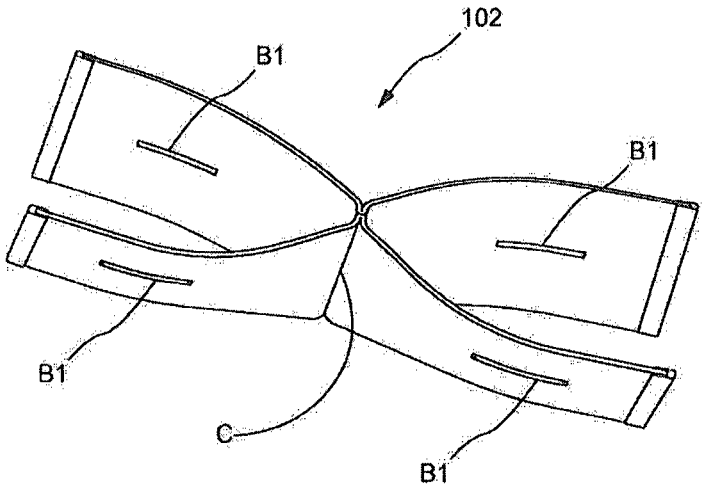
FIGS. 9*a* and 9*b* are two views of a second embodiment of the joining element according to the invention.
Figure 9B:
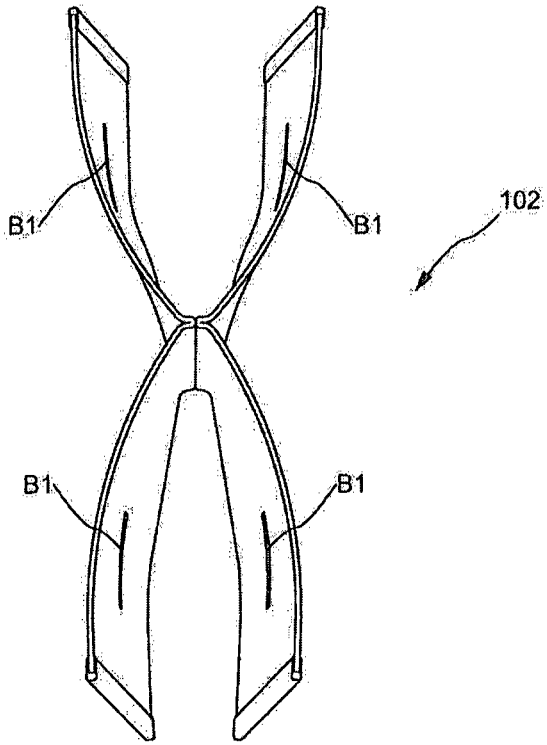

FIGS. 9*a* and 9*b* show a second embodiment of the invention which is functionally similar to the first embodiment. For the sake of convenience and so as not to overcomplicate the present description, the description provided for the first embodiment will not be repeated in its entirety, but just the differences will be mentioned.

The joining element 102 according to the second embodiment also comprises a first part and a second part. Differently from the first embodiment, the first and second parts are substantially the same as each other and are substantially similar to the second part B of the first embodiment 101. Therefore, the joining element 102 according to the second embodiment is a body which is substantially symmetrical where each of the two parts B comprises edge portions which are not in the form of a closed loop. Each of the four edge portions has an eyelet B1 for engagement with a button D3.

Figure 10:
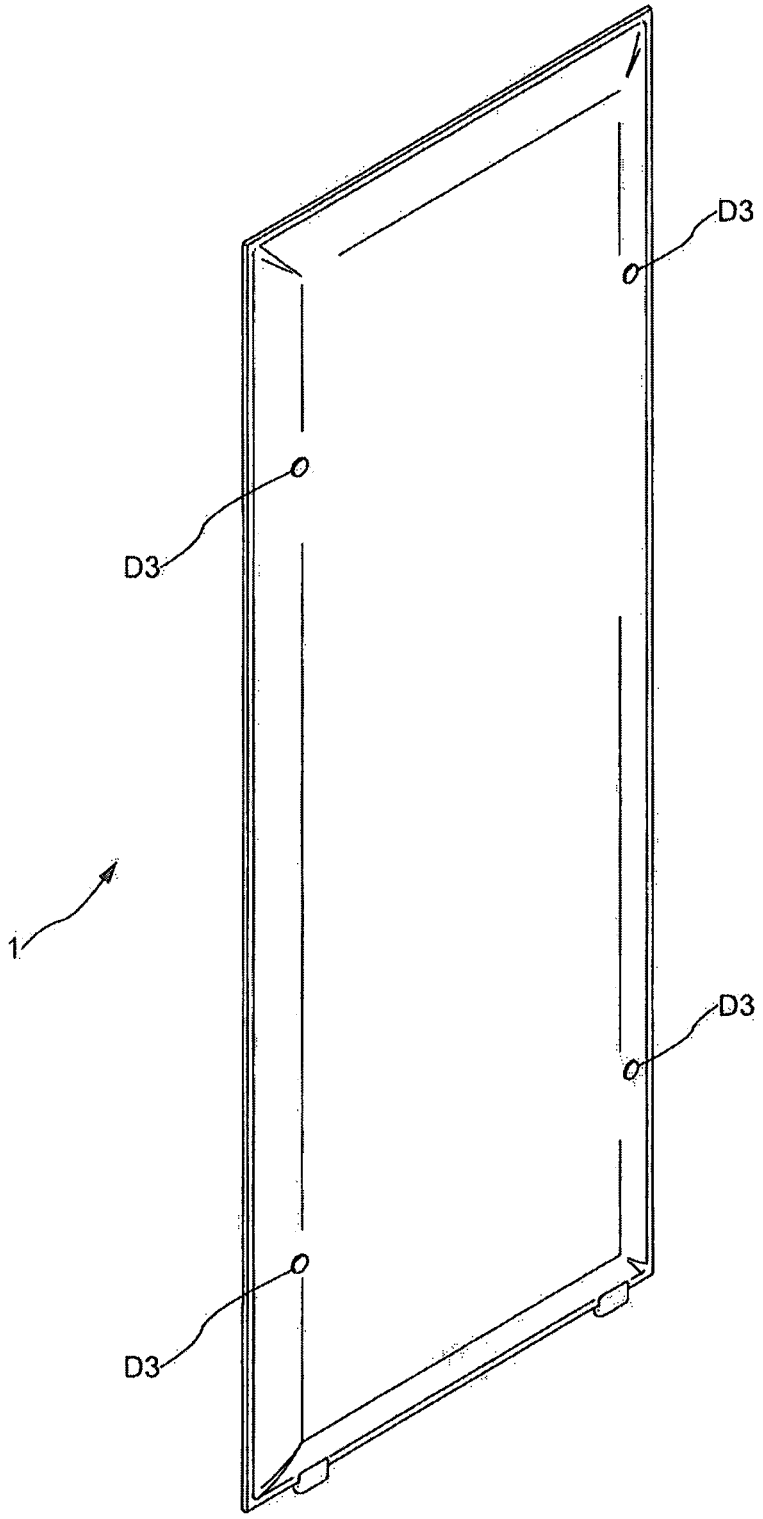
FIG. 10 is an axonometric view of a panel with buttons suitable for cooperating with the joining element according to FIG. 9.

FIG. 10 shows a panel, for example a panel 1 described in detail above, with four buttons D3 for each side surface (the opposite side surface is not shown since it is understood that the buttons are arranged in the same configuration). Preferably, the buttons D3 are arranged along a top row and along a bottom row, symmetrically with respect to a vertical axis and a horizontal axis.

Each button D3 is preferably fixed at a same distance from the edge of the panel, typically a few centimeters for example 4-6 cm.

Each of the buttons D3 may be fixed to the panel 1 in any known manner, for example by means of riveting or by means of a screw. Each button D3 (schematically shown in FIG. 13) has a shank G and a head T with a diameter greater than that of the shank.

A button D3 could also be fixed to a plate or to a strip associated with the panel in various ways, for example by means of gluing, Velcro-type fastening systems or the like.

Figure 11:
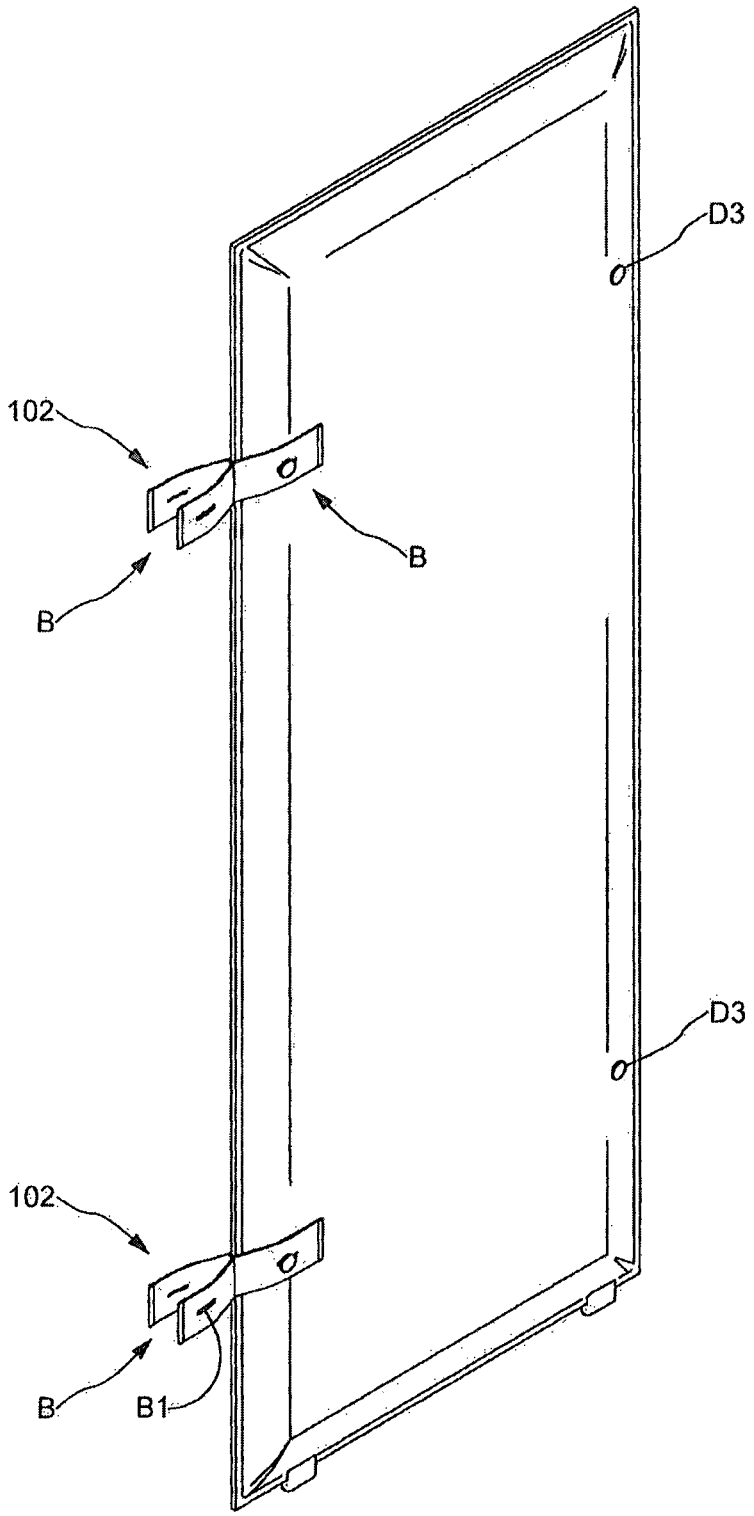
FIG. 11 shows the panel according to FIG. 10 with two joining elements according to FIG. 9.
Figure 12:
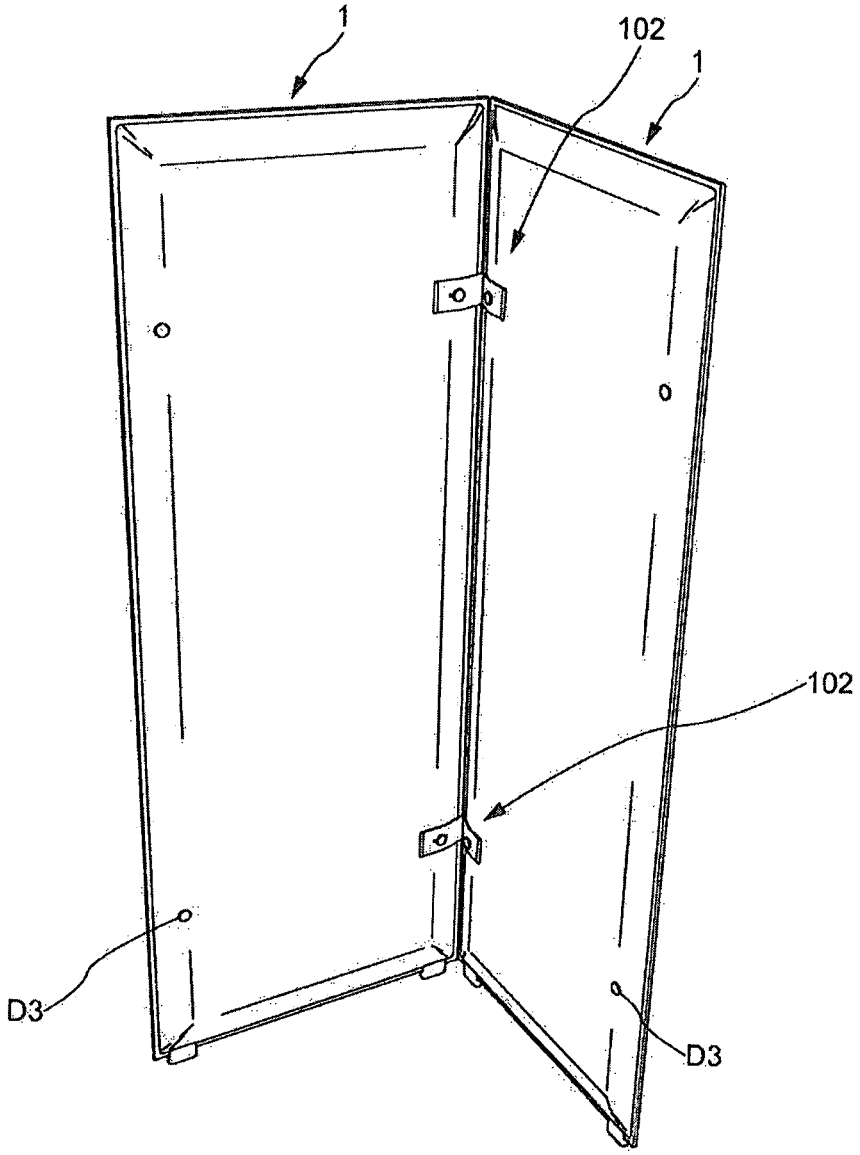
FIG. 12 shows two panels joined together with joining elements according to the second embodiment.

As shown in FIG. 11, two edge portions L of each joining element are fixed to two buttons D3 of the panel by passing the heads T of the buttons D3 through the eyelets B1. FIG. 12 shows two panels 1 which are joined together by means of two joining elements 102 according to the second embodiment. Obviously, the two panels 1 may also be positioned differently from that shown.

Figure 13:
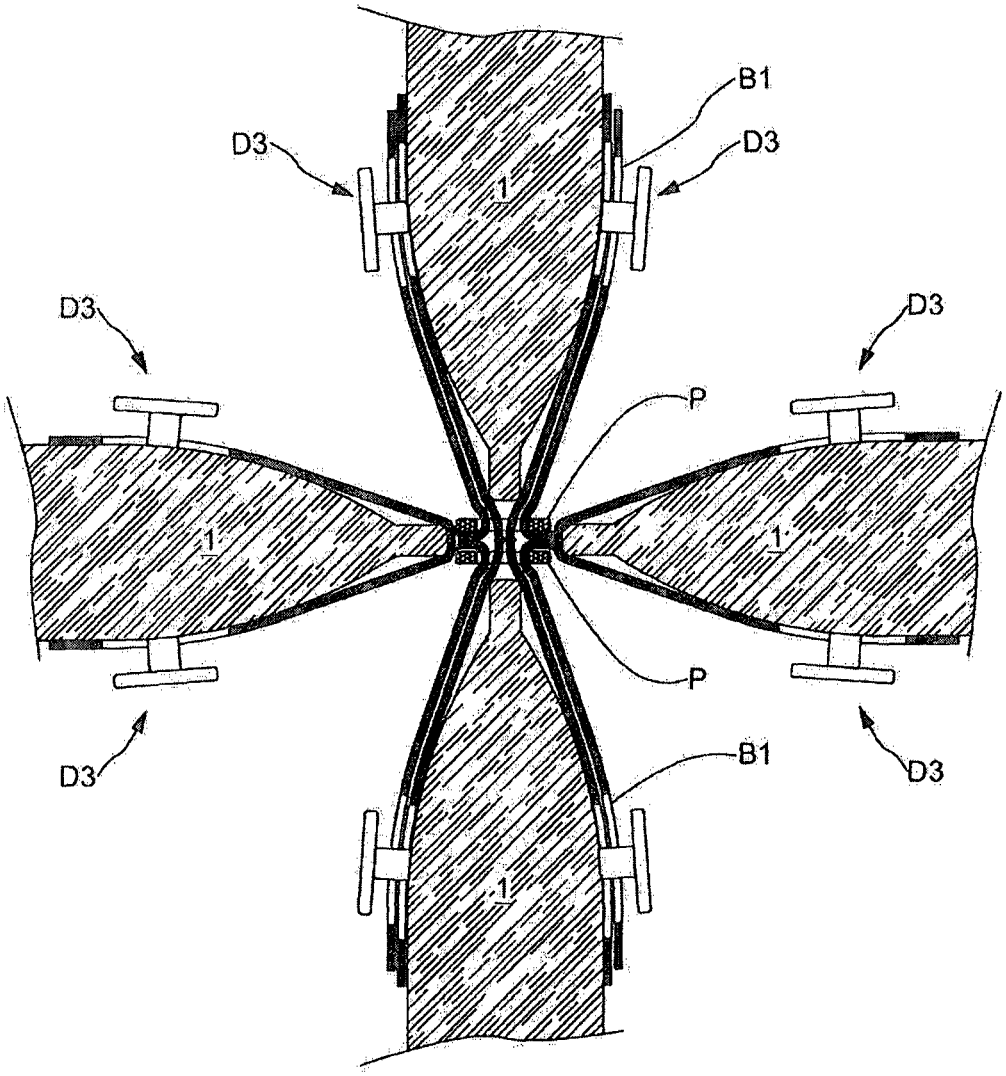
FIG. 13 is a schematic cross-sectional view of four panels connected together by means of joining elements according to the second embodiment.

As for the first embodiment, in addition to linear configurations it is also possible to connect the panels 1 so as to form angled arrangements. This possibility is shown in FIG. 13. In practice, for each panel a joining element 102 according to the second embodiment is used, with eyelets B1 which are engaged with buttons D3 fixed to another panel.

Advantageously, in a similar manner to the first embodiment, sleeves P, preferably two substantially rigid sleeves (made of metal, plastic or the like), are used.

Figure 14A:
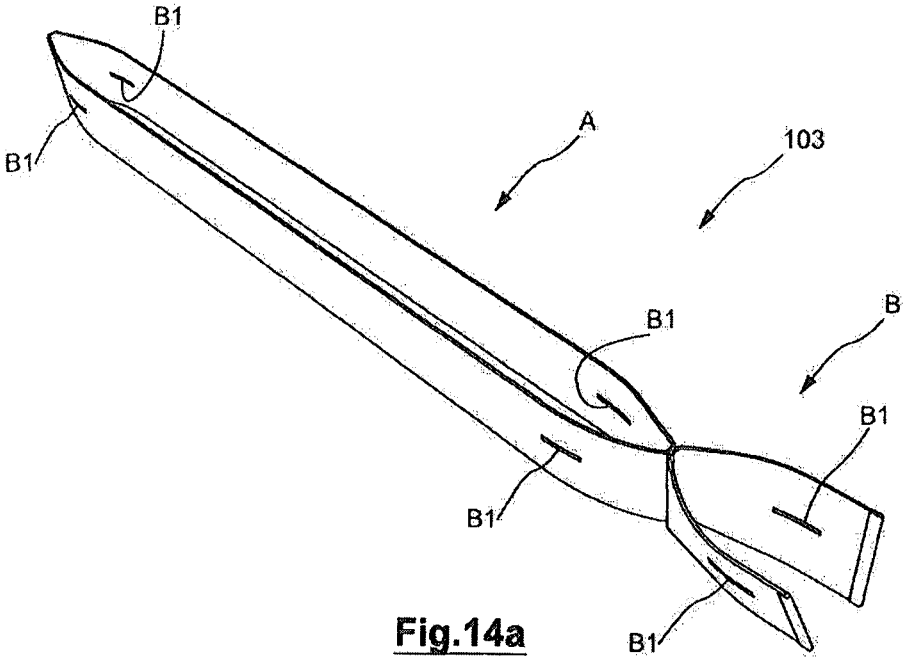
FIGS. 14*a* and 14*b* are two views of a third embodiment of the joining element according to the invention.
Figure 14B:
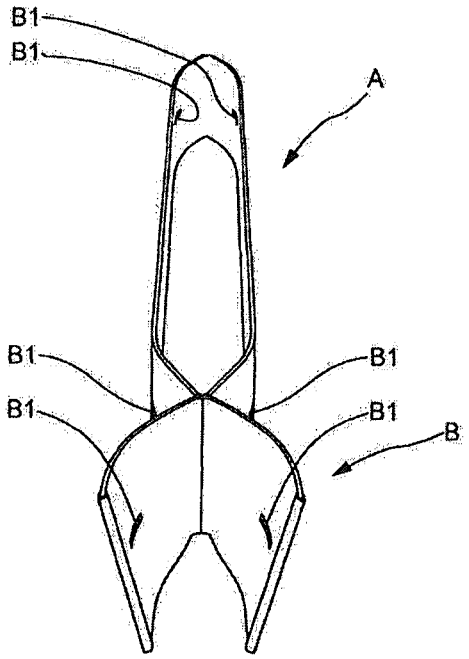

FIGS. 14*a* and 14*b* show a third embodiment of a joining element 103 according to the invention. The third embodiment 103 is similar to the first embodiment 101 since the first part is shaped as a closed loop and the second part comprises two edge portions with free ends. In a similar manner to the first and second embodiments, each edge portion is provided with an eyelet B1 for engagement with a button. Differently from the first embodiment, the first part A does not comprise buttons, but eyelets B1. The buttons D3, in a similar manner to the second embodiment, are fixed to (or in any case may be associated with) the panels 1.

Figure 15:
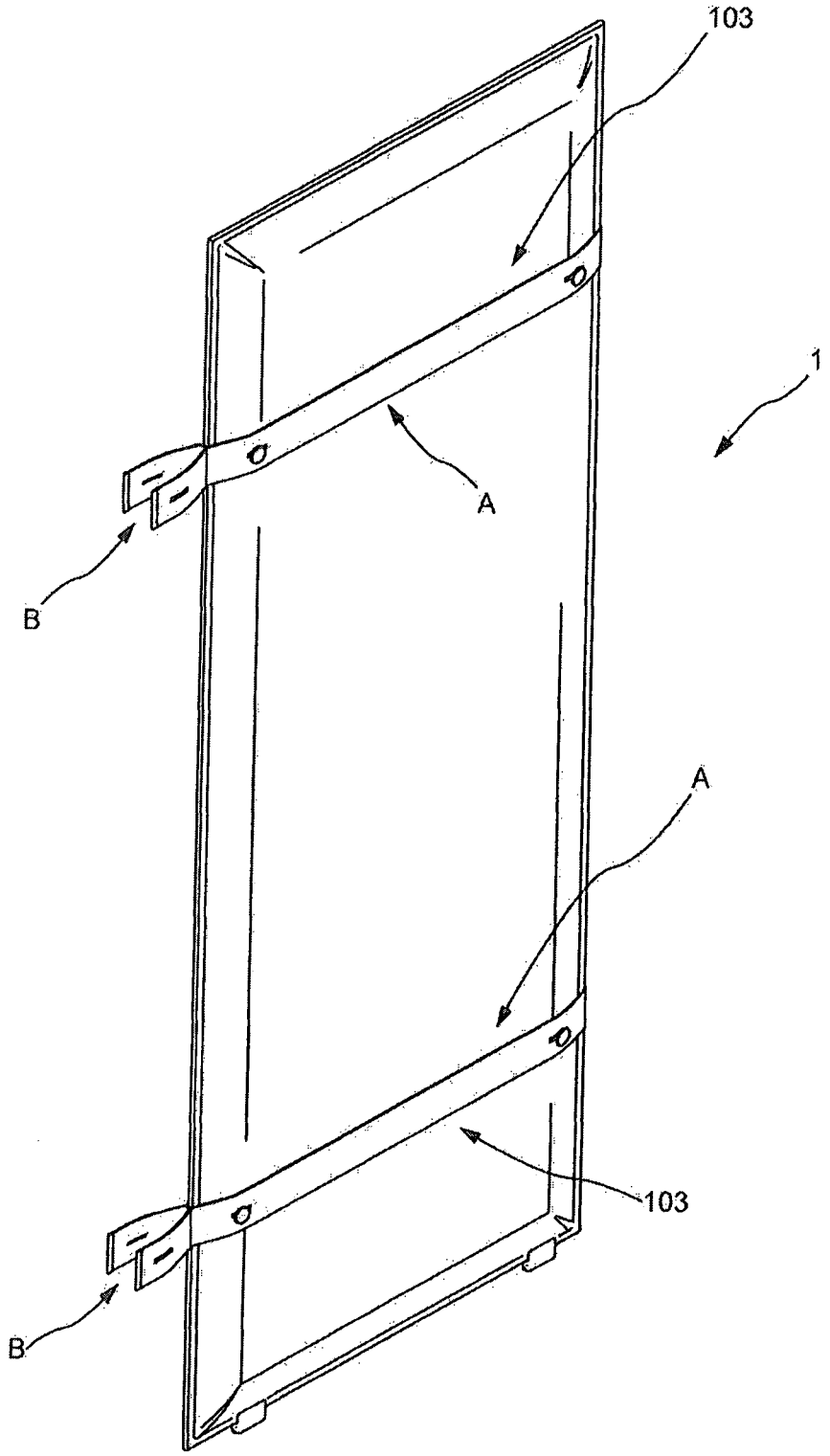
FIG. 15 shows the panel according to FIG. 10 with two joining elements according to FIG. 14.

FIG. 15 shows two joining elements 103 according to the third embodiment of the invention associated with a panel 1. The panel thus equipped is ready to be connected to another panel.

Figure 16:
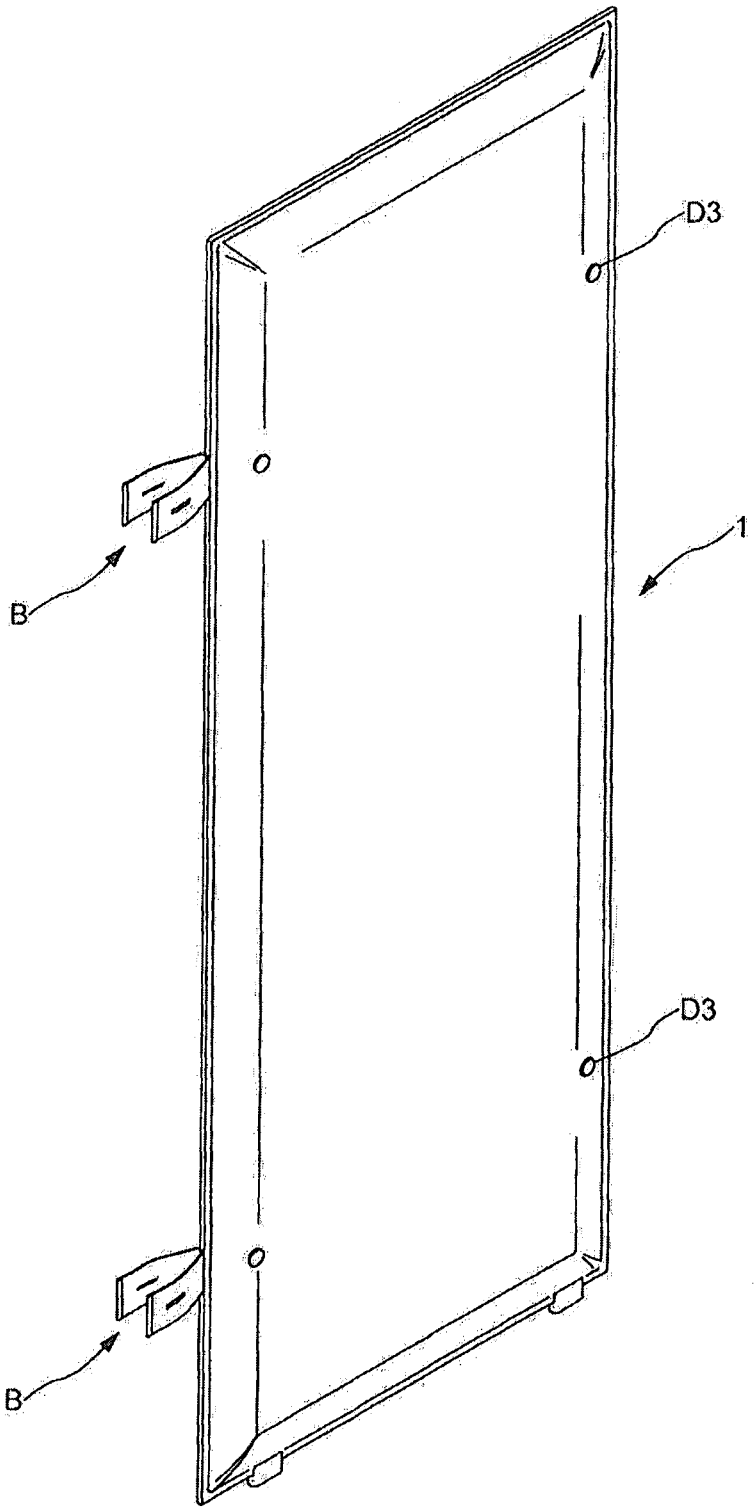
FIG. 16 shows the panel according to FIG. 10 with two joining elements according to a fourth embodiment.

According to a fourth embodiment, shown in FIG. 16, two (or more) joining elements are directly connected to a panel. For example, they may be stitched or glued.

The strips which form the joining elements according to the invention, preferably, are made of a material which is slightly elastic so as to adhere to the shape of the panel 1. The strips which form the joining elements according to the invention could be made of textile material or also a non-textile material, for example they could be made of moulded plastic or punched from a flexible material.

In embodiments, the strip has a height of between 4 and 6 cm, preferably between about 4.5 and about 5 cm. In embodiments, the strip has a thickness of between 1 and 3 mm, for example about 1.5-2.0 mm.

Preferably, the dimension of the closed-loop part of the joining element according to the invention is slightly smaller than the perimeter of the cross-section of the panel 1. In this way the loop adheres to the panel and maintains the predefined position.

The joining elements may be freely positioned at any height and may be positioned so as to join together panels of different heights.

Advantageously, the panels joined together by means of the invention may be easily and rapidly disassembled and reconfigured in other positions. The joining elements may be engaged with each other and then disassembled and if necessary completely removed from the panel. Fastening/release may be performed several times without adversely affecting the functionality of the fastening system.

Advantageously, the panels, even without being disassembled, may be folded up together so as that they can stowed away or transported.

Advantageously, the joining elements according to the various embodiments may be combined with each other. In other words, for example, in order to join together two panels, four joining elements of the same type or two of one type and two of another type may be used. The invention therefore offers many combinations and possibilities for connecting together two or more panels.

Advantageously, movable walls or partitions for offices, exhibition areas, shops, shopping centres, etc., may be provided.

The invention claimed is:

1. A joining element for connecting together a first panel and a second panel, wherein said first and second panels are sound-proofing or sound-reflecting panels, wherein each of said panels comprises a front side surface a back side surface and a peripheral edge, said joining element further comprising:

a strip section wherein said strip section forms a first part and a second part which are connected together along a hinge line or hinge area;

wherein said first part is shaped as a closed loop and is configured to embrace said first panel and to contact a portion of the front side surface, a portion of the back side surface and a portion of the peripheral edge of said first panel, said first part further comprising a first button and a second button, the first and second buttons being arranged in a way that when the first part embraces the first panel, the first button projects outwardly from the front side surface and the second button projects outwardly from the back side surface;

wherein said second part comprises a first edge portion terminating with a free and a second edge portion terminating with a free end; and wherein said first edge portion comprises a first eyelet and said second edge portion comprises a second eyelet, the first eyelet being configured to engage a further first button of a further joining element embracing the second panel and the second eyelet being configured to engage a further second button of the further joining element embracing the second panel.

2. The joining element according to claim 1, wherein said strip section is made of an at least partially elastic material.

3. The joining element according to claim 1, wherein said strip section is made of a textile material.

4. The joining element according to claim 1, wherein the strip section has a height of between 40 mm and 60 mm and has a thickness of between 1 mm and 3 mm.

5. A joining element for connecting together a first panel and a second panel, wherein said first and second panels are sound-proofing or sound-reflecting panels, each of said panels comprises a front side surface, a back side surface and a peripheral edge, wherein the first panel comprises a first button projecting outwardly from said front side surface and a second button projecting outwardly from said back side surface and wherein the second panel comprises a third button projecting outwardly from said front side surface and a fourth button projecting outwardly from said back side surface, said joining element further comprising:

a strip section wherein said strip section forms a first part and a second part which are connected together along a hinge line or hinge area;

wherein said first part comprises a first edge portion terminating with a first free end and a second end portion terminating with a second free end, wherein said first edge comprises a first eyelet configured to engage with the first button and said second edge comprises a second eyelet configured to engage with the second button;

wherein said second part comprises a third edge portion terminating with a third free end and a fourth end portion terminating with a fourth free, wherein said third edge portion comprises a third eyelet configured to engage with the third button and said fourth edge portion comprises a fourth eyelet configured to engage with the fourth button.

6. The joining element according to claim 5, wherein said strip section is made of an at least partially elastic material.

7. The joining element according to claim 5, wherein said strip section is made of a textile material.

8. A joining element for connecting together a first panel and a second panel, wherein said first and second panels are sound-proofing or sound-reflecting panels, wherein each of said panels comprises a front side surface, a back side surface and a peripheral edge, wherein the first panel comprises a first button projecting outwardly from said front side surface and a second button projecting outwardly from said back side surface and wherein the second panel comprises a third button projecting outwardly from said front side surface and a fourth button projecting outwardly from said back side surface, said joining element further comprising:

a strip section wherein said strip section forms a first part and a second part which are connected together along a hinge line or hinge area;

wherein said first part is shaped as a closed loop and is configured to embrace said first panel and to contact a portion of the front side surface, a portion of the back side surface and a portion of the peripheral edge of the first panel;

wherein said first part comprises a first eyelet and a second eyelet, the first and second eyelets being arranged in a way that when the first part embraces the first panel, the first button engages with the first eyelet and the second button engages with the second eyelet;

wherein said second part comprises a first edge portion terminating with a first free end and a second edge portion terminating with a second free end; and wherein said first edge portion comprises a third eyelet and said second edge portion comprises a fourth eyelet, the third eyelet being configured to engage the third button of the second panel and the fourth eyelet being configured to engage the fourth button of the second panel.

9. The joining element according to claim 8, wherein said strip section is made of an at least partially elastic material.

10. The joining element according to claim 8, wherein said strip section is made of a textile material.

11. The joining element according to claim 8, wherein the strip section has a height of between 40 mm and 60 mm and has a thickness of between 1 mm and 3 mm.

* * * * *